US005374868A

United States Patent [19]

Tjaden et al.

[11] Patent Number: 5,374,868

[45] Date of Patent: Dec. 20, 1994

[54] METHOD FOR FORMATION OF A TRENCH ACCESSIBLE COLD-CATHODE FIELD EMISSION DEVICE

[75] Inventors: Kevin Tjaden; J. Brett Rolfson, both of Boise, Id.

[73] Assignee: Micron Display Technology, Inc., Boise, Id.

[21] Appl. No.: 943,966

[22] Filed: Sep. 11, 1992

[51] Int. Cl.[5] ..... H01J 1/30

[52] U.S. Cl. ..... 313/310; 445/51

[58] Field of Search ..... 313/306, 307, 308, 309, 313/310, 336, 351; 445/24, 50, 51; 340/781; 345/74, 75, 82; 437/225, 228, 235

[56] References Cited

U.S. PATENT DOCUMENTS

| | | | |
|---|---|---|---|
| 3,665,241 | 5/1972 | Spindt et al. | 313/351 |
| 3,755,704 | 8/1973 | Spindt et al. | 313/309 |
| 3,812,559 | 5/1974 | Spindt et al. | 29/25.18 |
| 3,970,887 | 7/1976 | Smith et al. | 313/309 |
| 3,998,678 | 12/1976 | Fukase et al. | 313/309 |
| 4,008,412 | 2/1977 | Yuito et al. | 313/309 |
| 4,513,308 | 4/1985 | Greene et al. | 313/309 |
| 4,983,878 | 1/1991 | Lee et al. | 313/336 |
| 5,063,323 | 11/1991 | Longo et al. | 313/309 |
| 5,064,396 | 11/1991 | Spindt et al. | 445/50 |
| 5,194,780 | 3/1993 | Meyer | 313/309 |
| 5,199,917 | 4/1993 | MacDonald et al. | 313/336 |

FOREIGN PATENT DOCUMENTS 0416625 3/1991 European Pat. Off. .

*Primary Examiner*—Richard Hjerpe
*Assistant Examiner*—Steven J. Saras
*Attorney, Agent, or Firm*—Lia M. Pappas

[57] ABSTRACT

A field emitter structure is formed, having trench accessible cold cathode tips is fabricated by forming trenches in a substrate. The trenches are subsequently filled with a conformal insulating layer, a highly conductive layer, and a polysilicon layer. The layers are etched to form emitter tips which are disposed contiguous with the trenches. Electrical signals are propagated through the trenches permitting increased performance of the emitter structure.

19 Claims, 7 Drawing Sheets

METHOD FOR FORMATION OF A TRENCH ACCESSIBLE COLD-CATHODE FIELD EMISSION DEVICE

FIELD OF THE INVENTION

This invention relates to field emission devices, and more particularly, to a process for creating trench isolated emitter structures.

BACKGROUND OF THE INVENTION

Flat panel displays have become increasingly important in appliances requiring lightweight portable screens. Currently, such screens use electroluminescent or liquid crystal technology. A promising technology is the use of a matrix-addressable array of cold cathode emission devices to excite phosphor on a screen.

Spindt, et. al. discuss field emission cathode structures in U.S. Pat. Nos. 3,665,241, and 3,755,704, and 3,812,559, and 5,064,396. To produce the desired field emission, a potential source is provided with its positive terminal connected to the gate, or grid, and its negative terminal connected to the emitter electrode (cathode conductor substrate). The potential source may be made variable for the purpose of controlling the electron emission current. Upon application of a potential between the electrodes, an electric field is established between the emitter tips and the low potential anode grid, thus causing electrons to be emitted from the cathode tips through the holes in the grid electrode, and then onto a phosphor coated anode screen.

An array of points in registry with holes in low potential anode grids are adaptable to the production of cathodes subdivided into areas containing one or more tips from which areas emissions can be drawn separately by the application of the appropriate potentials thereto.

In U.S. Pat. No. 3,970,887, entitled, "Micro-structure Field Emission Electron Source," Smith et al describe a method of electrically isolating emission sites by appropriately doping the semiconductor substrate to provide opposite conductivity type regions at the field emission sites.

The field emission sites of the present invention are physically isolated by a dielectric layer which has a high resistance. The dielectric layer is deposited in a trough or trench created in the substrate. A polysilicon layer or other suitable conductive material, such as titanium salicide, is deposited on top of the dielectric layer, thereby providing good electrical signal propagation down the row (or column) of emitters.

One advantage of the present invention is an increase in process and design flexibility which results from the fact that the cathode material is decoupled from the substrate by the presence of the insulator. Another advantage is the greater range of materials which can be used for both the substrate and the emitters.

A further advantage of the trench isolated accessibility of the emitter tips according to the present invention, is the elimination of the need for costly implants. Leakage is also reduced.

A still further advantage is that the conductive material used to form the trench accesses can be different from the material used to form the cathode emitters, thereby increasing the speed and efficiency of the display. The highly conductive material deposited in the trenches can be selected from a group of materials having good electrical signal propagation abilities, and the cathode material can be selected for electron emission capabilities.

SUMMARY OF THE INVENTION

A cathode emitter structure of the present invention comprises a substrate having troughs disposed therein, a highly conductive material layer disposed in the troughs, and emitter tips disposed superjacent the highly conductive layer.

A process for the formation of the physically isolated emission structures of the present invention, comprises the following steps of: forming trenches in a substrate, depositing or growing a conformal insulating layer superjacent the substrate, the conformal insulating layer is for isolating emitter tips, depositing a conductive layer superjacent the insulated trenches, the conductive layer for propagating an electrical signal through the trenches to the emitter tips, and etching the conductive layer thereby forming the emitter tips.

A method for the formation of a baseplate having isolated emitter structures of the present invention, comprises the following steps of: forming troughs in a substrate depositing a highly conductive layer superjacent the conformal dielectric layer, depositing a cathode material layer superjacent the dielectric layer, the cathode material layer comprising polysilicon, and etching the layers, thereby forming conical cathodes contiguous with the troughs.

BRIEF DESCRIPTION OF THE DRAWINGS

The present invention will be better understood from reading the following description of nonlimitative embodiments, with reference to the attached drawings, wherein.

DETAILED DESCRIPTION OF THE INVENTION

Figure 1:
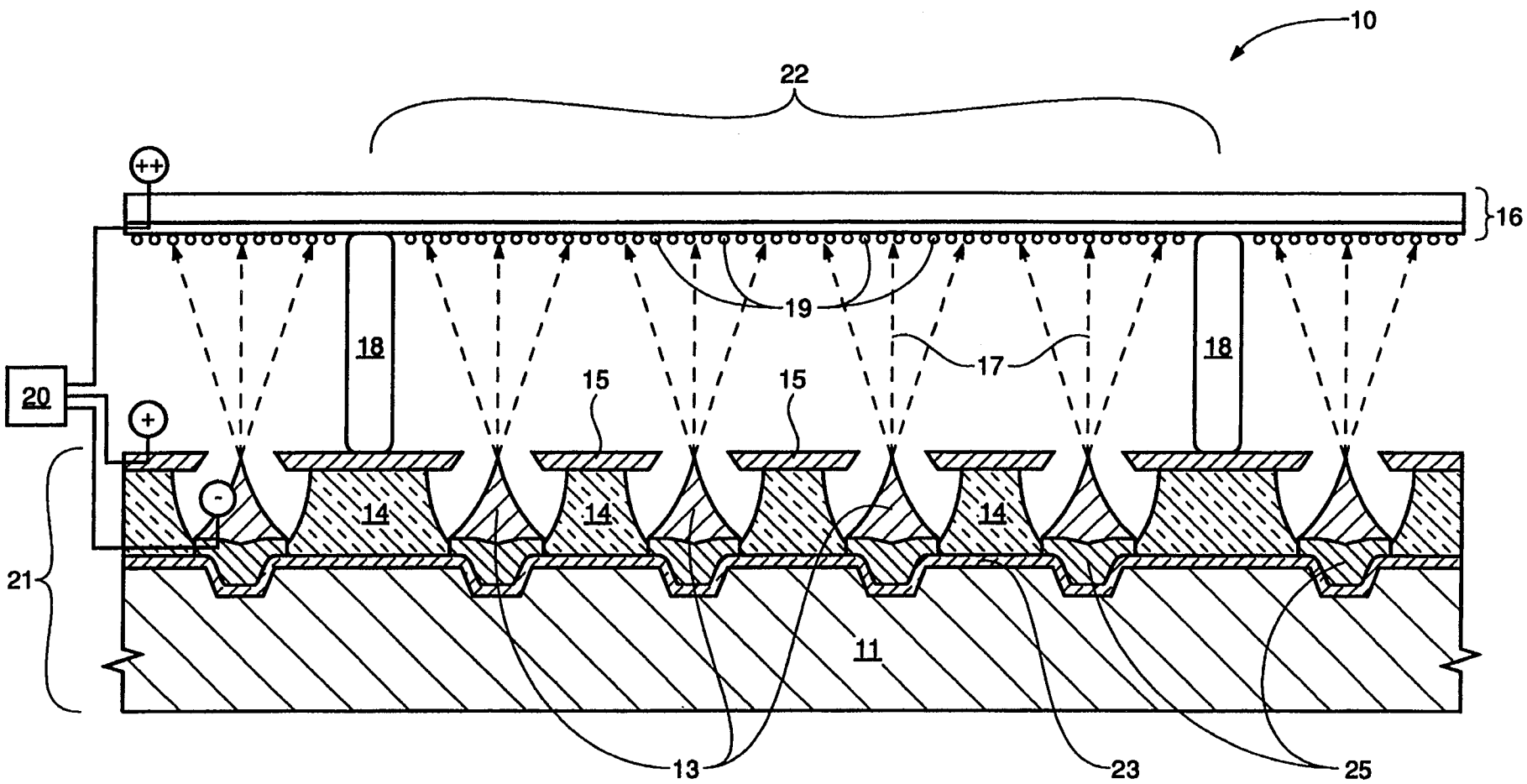
FIG. 1 is a cross-sectional schematic drawing of a field emission display.

Referring to FIG. 1, a field emission display 10 employing pixel 22 is depicted. In the preferred embodiment, a single crystal silicon layer serves as a substrate 11 onto which an insulative material layer 23, has been grown or deposited. However, one having ordinary skill in the art will recognize that there are many other suitable substrates 11, such as, for example, polycrystalline solar cells, glass, and ceramic substrates. The substrate 11 can be comprised of an insulator material, or a semiconductor material, or even a conductor.

At a field emission site, a conical micro-cathode 13 has been constructed on top of the substrate 11. Surrounding the micro-cathode 13, is an anode gate structure 15 having a positive voltage relative to the micro-cathode 13 during emission. When a voltage differential, through source 20, is applied between the cathode 13 and the gate 15, a stream of electrons 17 is emitted toward a phosphor coated screen 16. Screen 16 is an anode. The electron emission tip 13 is integral with a conductive material layer 25. The insulative layer 23 prevents leakage between the semiconductor substrate 11 and the cathode tips 13, as well as limits "crosstalk" between tips 13. Gate 15 serves as a low potential anode or grid structure for its respective cathode 13. A dielectric insulating layer 14 is deposited on the insulative layer 23. The insulator 14 also has an opening at the field emission site location.

The baseplate 21 of the field emission display 10 comprises a matrix addressable array of cold cathode emission structures 13, the substrate 11 on which the emission structures 13 are created, the insulative material layer 23, the insulating layer 14, and the anode grid 15.

Disposed between the faceplate 16 and the baseplate 21 are located spacer support structures 18 which function to support the atmospheric pressure which exists on the electrode faceplate 16 as a result of the vacuum which is created between the baseplate 21 and faceplate 16 for the proper functioning of the emitter tips 13.

Figure 2:
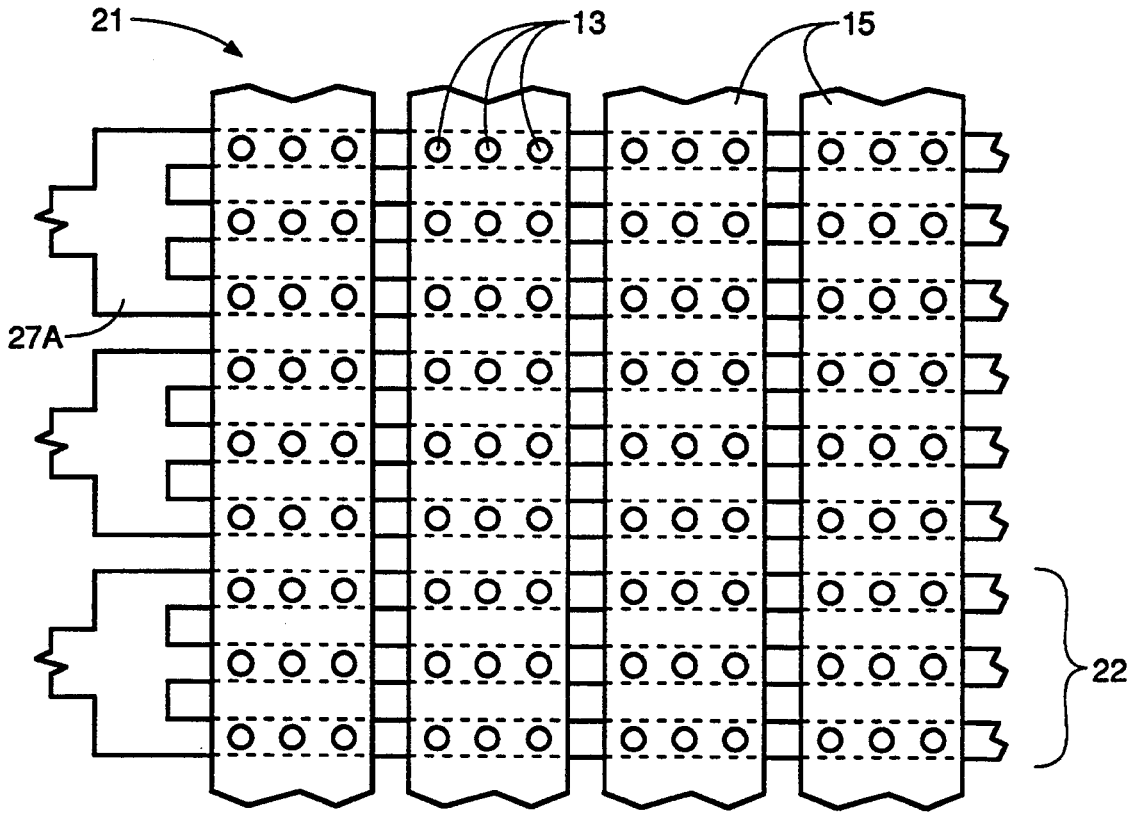
FIG. 2 is a schematic drawing of a top view of a baseplate of a field emitter display further illustrating the trench isolated emitter tips of the present invention.
Figure 3:
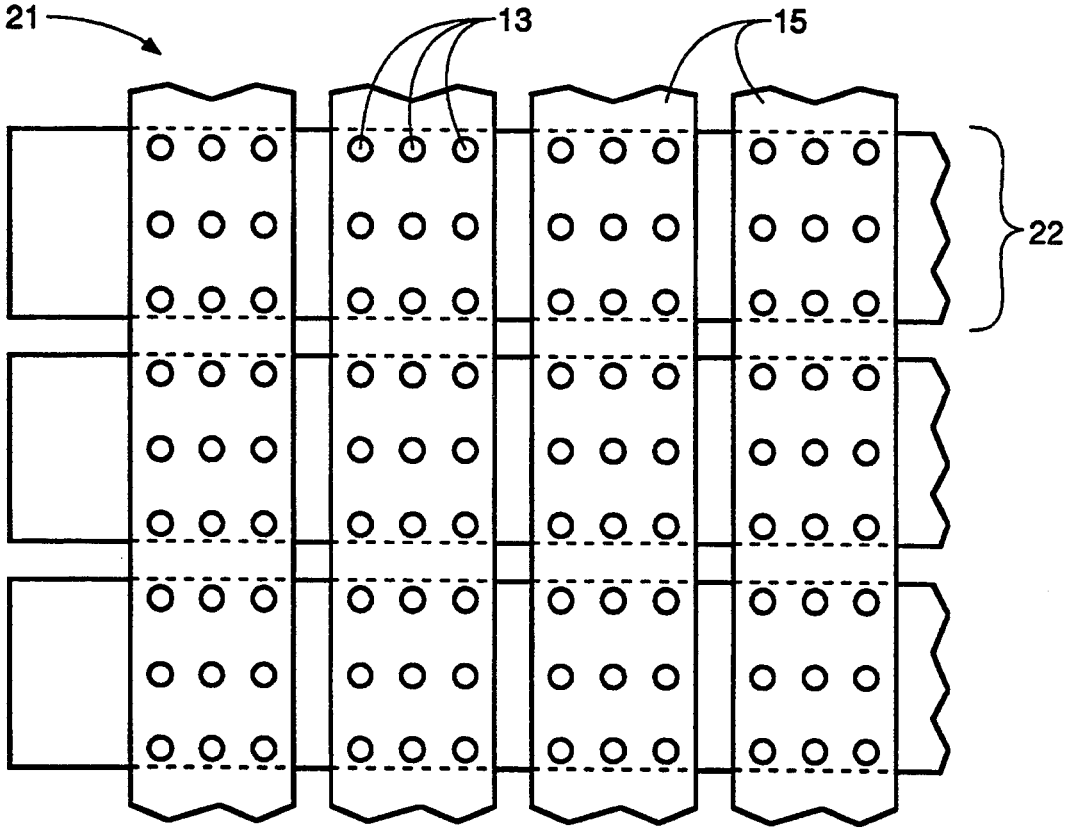
FIG. 3 is an alternative schematic drawing of a top view of a baseplate of a field emitter display further illustrating the trench isolated emitter tips of the present invention.

FIGS. 2 and 3 are top views of the baseplate 21, and emitter array of the present invention. The emitters 13 are arranged in pixels 22. In this example, each pixel 22 contains nine emitters 3. However, one having ordinary skill in the art would understand that there is wide latitude in the number of cathode tips 13 that can be arranged to form a pixel 22. The emitter tips 13 are addressable through trenches 27 having an insulating layer 23 deposited therein. Thus, a whole row (or column) can be addressed through the same trench 27.

Figure 2A:
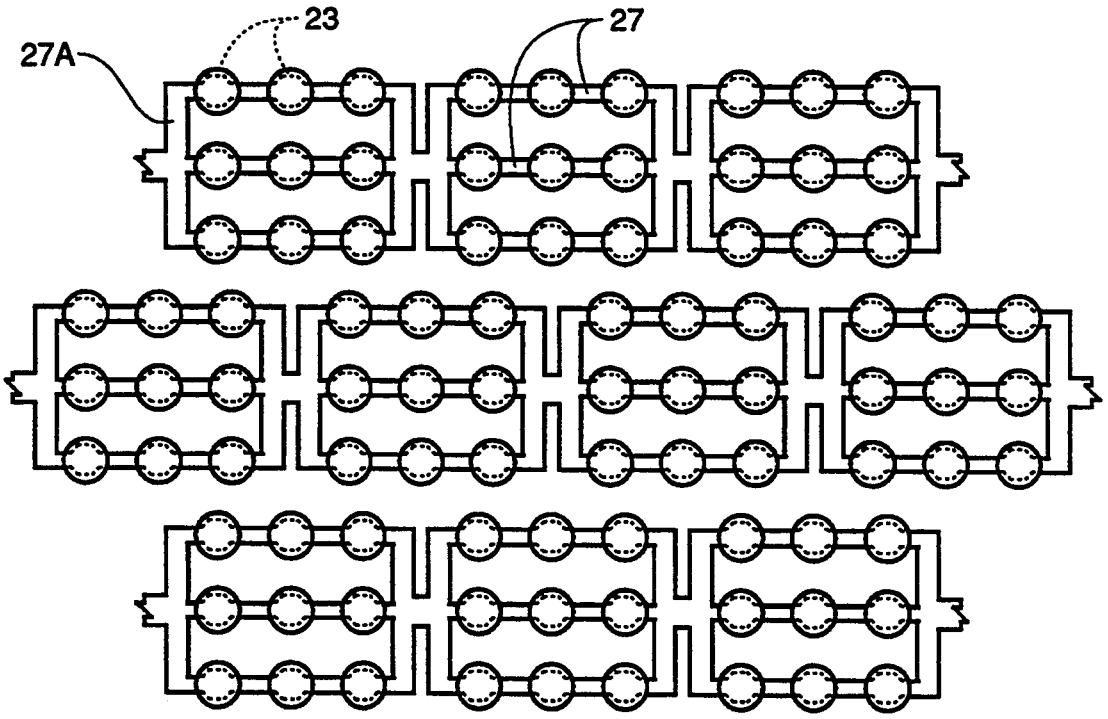
FIG. 2A is a schematic drawing of a top view of the trenches of FIG. 2, further illustrating the alignment of the emitter tips at the appropriate locations.

In the preferred embodiment shown in FIGS. 2 and 2A, a single row (or column) of tips 13 is arranged in each dielectric-insulated 23 trench 27. Several trenches 27 are connected at 27*a*, thereby enabling a single signal to be propagated down the whole row (or column). In FIG. 2, the emitter tips 13 are shown in even rows and columns. An alternative embodiment is to stagger the pixels 22, as shown in FIG. 2A.

In the alternative embodiment of FIG. 3, several whole pixels 22 are addressable through a single trench 27.

FIG. 2A also illustrates the alignment of the emitter tips 13 at the appropriate sites above the trenches 27. Preferably, the base of the emitter tip 13 is slightly larger than the opening at the trench 27 where the tip 13 is disposed. In the preferred embodiment, the tips 13 are not disposed within the trench 27, but rest on the surface of the opening of the trench 27. The location of the tips 13 on top of the trenches 27 adds greater alignment tolerance during the manufacturing process. Functional tips 13 are obtainable despite slight variations in alignment when registering one pattern to another during fabrication. The use of trenches 27 which have openings which are narrower than the base of the tips 13 disposed thereon also minimizes the occurrence of strange geometries and other filling problems which arise when subsequent films are deposited. Nonetheless, disposing the tips 13 within the trenches 27 is a functional embodiment.

Figure 4:
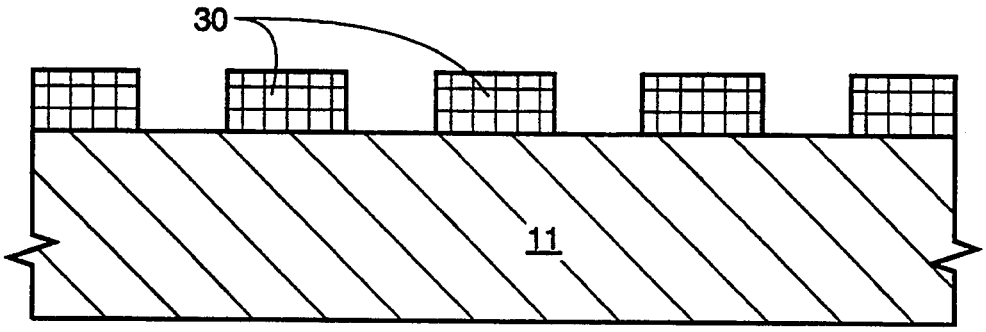
FIG. 4 is a cross-sectional schematic drawing of a substrate patterned for trench sites according to the process of the present invention.

The structures of FIGS. 2 and 3 are preferably fabricated by the process described below. In FIG. 4 a mask layer 30 has been deposited on the substrate 11 thereby designating the sites where trenches or troughs 27 are to be formed. The mask 30 can be a photoresist layer or other suitable material known in the art.

Figure 5:
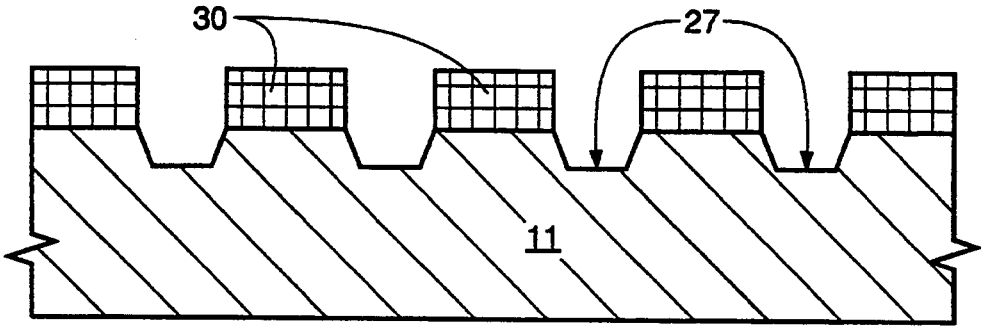
FIG. 5 is a cross-sectional schematic drawing of the substrate of FIG. 4, following trench formation.

The next step in the process is to etch the substrate 11 at the designated sites thereby forming the trenches 27. FIG. 5 illustrates the trenches 27 following the etch step. The size of the trenches 27 will vary with the size of the pixel 22. Relative dimensions of the trenches 27, prior to the deposition of the insulating layer 23, are $0.8\mu$ at the bottom and $1.2\mu$ at the opening. The base of the emitter tip 13 is preferably larger than the opening of the trench 27, thereby preventing the emitter tip 13 from being disposed down in the trench 27. The mask layer 30 is then removed.

Figure 6:
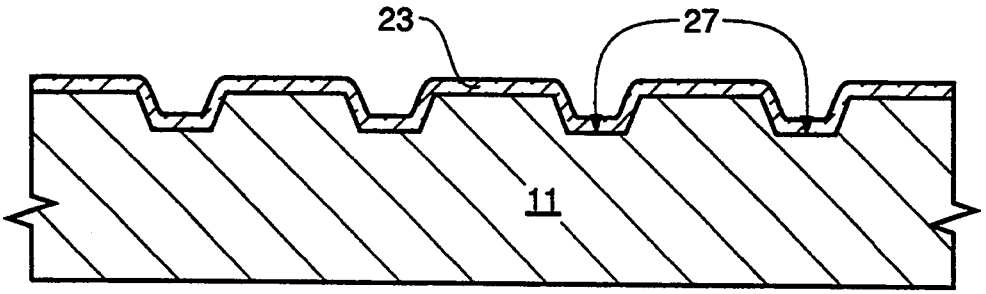
FIG. 6 is a cross-sectional schematic drawing of the substrate of FIG. 5, following deposition of an insulation layer in the trenches and along the surface of the substrate.

A conformal dielectric layer 23 is deposited (or "grown") in the trenches 27 and continues along the surface of the substrate 11, as illustrated in FIG. 6. Any suitable insulating material can be used to form the dielectric layer 23, such as silicon dioxide, silicon nitride, and boro-phospho-silicate glass (BPSG). In the case of silicon dioxide, the insulating layer 23 will be "grown" in the trenches 27. The dielectric layer 23 in the preferred embodiment is comprised of tetra ethyl-ortho-silicate glass (TEOS), which is a thermally deposited silicon dioxide. The depth of the dielectric layer 23 can be in the range of approximately 500–5000 Å. After the insulating layer 23 is grown or deposited in the trenches 27, the dimensions of the trenches 27 in the preferred embodiment become approximately $0.4\mu$ at the bottom and $0.6\mu$ at the opening of the trench 27.

If the substrate 11 selected is an insulator, there is no need to insulate the trenches 27, as the substrate 11 itself will limit undesired propagation of electrical signals through the unit 10. However, if the substrate 11 is a semiconductor material, and especially if the substrate 11 is a conductive material, the insulating layer 23 becomes an important factor in the proper operation of the unit 10.

Figure 7:
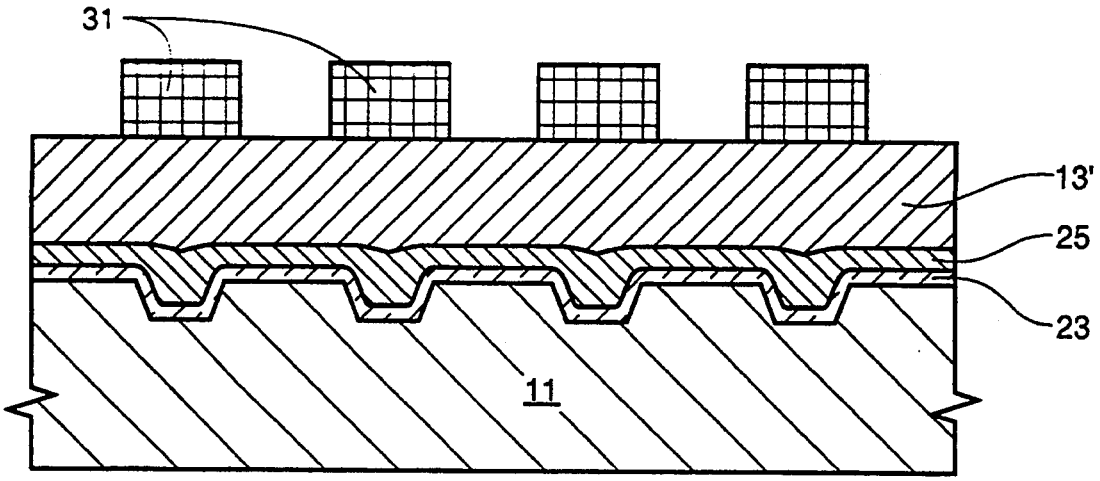
FIG. 7 is a cross-sectional schematic drawing of the substrate of FIG. 6, following the deposition of a highly conductive layer and cathode material layer.

Referring to FIG. 7, a suitable highly conductive material layer 25 e.g., tungsten silicide ($WSi_x$), having good electrical and good speed characteristics is preferably deposited superjacent the insulative dielectric layer 23, thereby filling the trenches 27 and extending to a height above the dielectric layer 23. A cathode material layer 13', preferably polysilicon, is deposited superjacent the highly conductive material layer 25. The level of the cathode layer 13' should be sufficient for tip 13 formation. A highly conductive material 25 is the preferred material for deposition in the trenches 27 because of its relatively low resistance, thereby providing good electrical signal propagation down the row (or column). Good signal propagation results in increased speed and increased performance of the unit 10.

A photoresist 31 is then patterned on the cathode material layer 13'. The photoresist pattern 31 designates the locations of the emitter tips 13. In the preferred embodiment, the pattern is done with a "hard" mask 31.

Figure 7A:
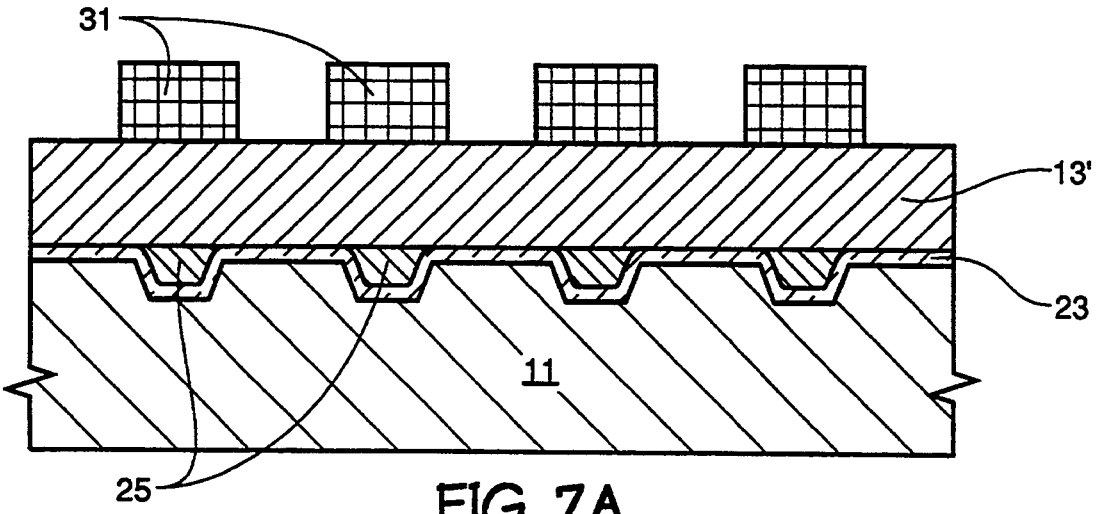
FIG. 7A is a cross-sectional schematic drawing of an alternative embodiment of the substrate of FIG. 6, following the deposition and subsequent planarization of a highly conductive layer, prior to the deposition of the cathode material layer.

In FIG. 7A, the highly conductive layer 25 can alternatively be planarized, if desired, using for example, chemical mechanical planarization (CMP) or other suitable method, to a level which can be above, even with, or just below the opening of the trench 27. Alternatively, the highly conductive layer 25 can be etched to the desired level. A cathode material layer 13', such as polysilicon is deposited superjacent the highly conductive layer 25, as in FIG. 7, and a mask 31 is patterned thereon.

Alternatively, one can simply deposit the cathode material layer 13' polysilicon in the trench 27. In such a case, the tips 13 would be disposed within the trenches 27.

Figure 8:
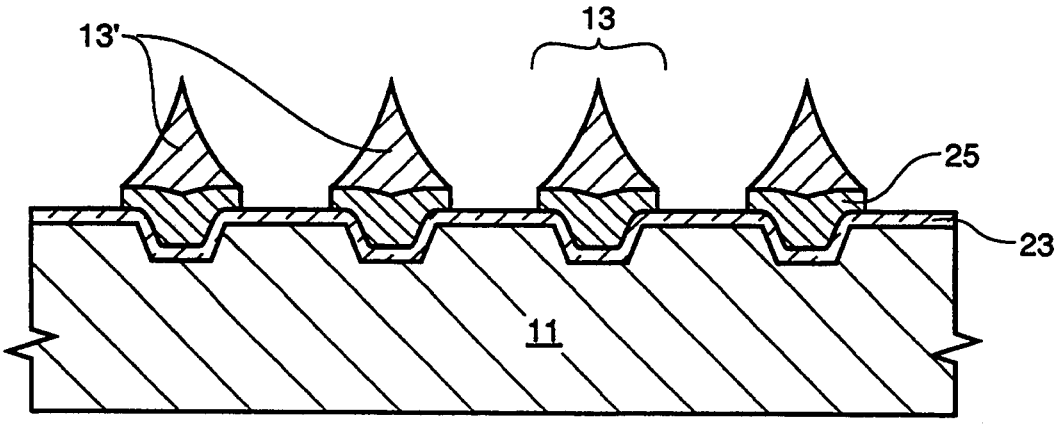
FIG. 8 is a cross-sectional schematic drawing of the substrate of FIG. 7, following tip formation from the deposited conductive layers.

FIG. 8 illustrates the emitter structure once the tips 13 have been fabricated. The cold cathode emitter tips 13 can be etched by any of the methods known in the art, preferably an anisotropic etch, i.e., one having undercutting. One example is found in co-pending application Ser. No. 07/883,074, entitled, "Plasma Dry Etch to Form Sharp Asperities Useful as Cold Cathodes," which has been assigned to the same assignee as the present application. The etch is selective to insulating layer 23, and will stop after the polysilicon layer 13' and highly conductive layer 25 have been etched.

Figure 8A:
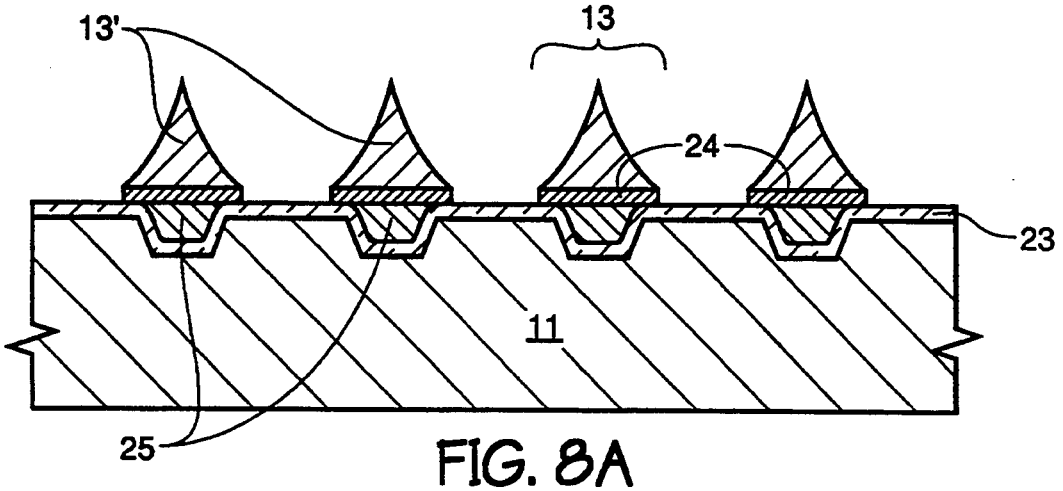
FIG. 8A is a cross-sectional schematic drawing of the substrate of FIG. 7A, following deposition of an etch stop layer prior to tip formation from the deposited conductive layers.

FIG. 8A illustrates the emitter structure of FIG. 7A after the cathode emitters 13 have been etched by a method similar to that used in the above embodiment. At this point, an oxidation step can be done to sharpen the tips 13.

Another alternative embodiment shown in FIG. 8A is the use of a conductive layer 24 which is selectively etchable to the cathode forming material 13'. The conductive layer 24 functions as an etch stop thereby inhibiting etching of the trench material 25 during formation of the tips 13. After the tips 13 are formed, the conductive layer 24 can be etched by any of the suitable methods known in the art.

Figure 9:
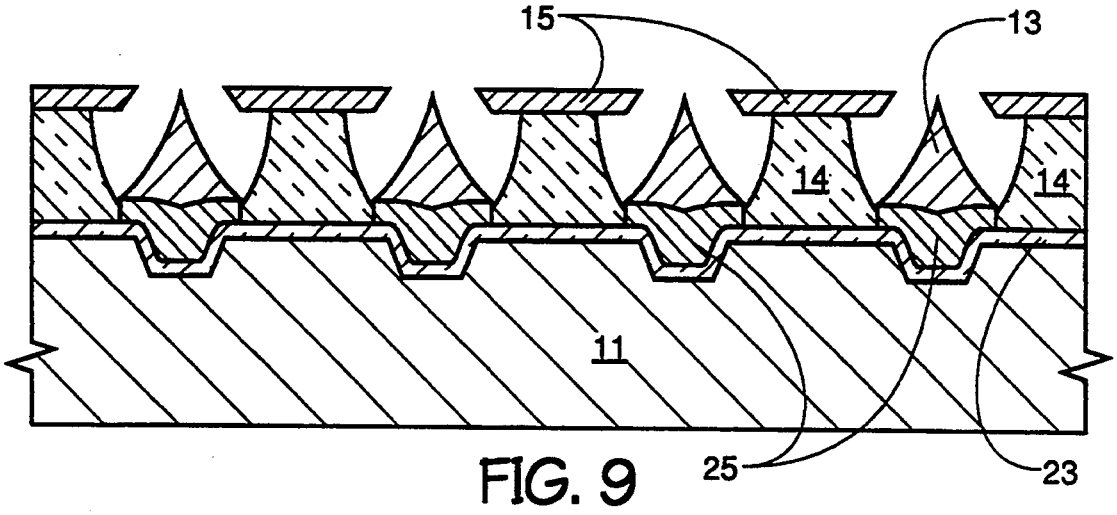
FIG. 9 is a cross-sectional schematic drawing of the substrate of FIG. 8, further illustrating grid and insulation layers.

FIG. 9 illustrates the emitter structure surrounded by an insulating layer 14 and gate anode 15. The preferred method of formation is described in co-pending application Ser. No. 07-837,453 entitled, "A Method to Form Self-Aligned Gate structures Around Cold Cathode Emitter Tips Using Chemical Mechanical Polishing," which has been assigned to the same assignee as the present application. The above-mentioned method describes a fabrication process in which a conformal insulating layer 14 is deposited superjacent the emitter tips 13. Superjacent the insulating layer 14, a conformal conductive material layer 15 is deposited, which conductive layer 15 will function as the anode grid 15 in the completed structure. Chemical mechanical polishing (CMP) is used to planarize the conductive layer 15 and insulating layer 14 to a level substantially similar to that of the emitter tip 13. A wet etch is performed to form the anode 15 to cathode 13 space.

If desired, the cathode tip 13 may optionally be coated with a low work function material. Low work function materials include, but are not limited to cermet ($Cr_3Si+SiO_2$), cesium, rubidium, tantalum nitride, barium, chromium silicide, titanium carbide, molybdenum, and niobium. Coating of the emitter tips may be accomplished in one of many ways. The low work function material or its precursor may be deposited through sputtering or other suitable means on the tip 13. Certain metals (e.g., titanium or chromium) may be reacted with the silicon of the tip to form silicide during a rapid thermal processing (RTP) step. Following the RTP step, any unreacted metal is removed from the tip 13. In a nitrogen ambient, deposited tantalum may be converted during RTP to tantalum nitride, a material having a particularly low work function. The coating process variations are almost endless. This results in an emitter tip 13 that may not only be sharper than a plain silicon tip, but that also has greater resistance to erosion and a lower work function. The silicide is formed by the reaction of the refractory metal with the underlying polysilicon by an anneal step.

The baseplate 21, as depicted in FIG. 9, can be aligned with the screen 16, and sealed by any of the methods known in the art, for example with a frit seal. A vacuum is then created in the space between the faceplate 16 and baseplate 21.

All U.S. patents cited herein are hereby incorporated by reference as if set forth in their entirety.

While the particular process as herein shown and disclosed in detail is fully capable of obtaining the objects and advantages herein before stated, it is to be understood that it is merely illustrative of the presently preferred embodiments of the invention and that no limitations are intended to the details of construction or design herein shown other than as described in the appended claims. For example, one having ordinary skill in the art will recognize that flat panels need not be limited to use in displays, but can be adapted for use in printing and other applications.

We claim:

1. A cathode emitter structure comprising:
   a substrate having troughs disposed therein;
   a conformal insulating layer disposed superjacent said substrate, said conformal insulating layer being a dielectric, and said dielectric comprising at least one of silicon dioxide, silicon nitride, BPSG, and TEOS;
   a highly conductive material layer substantially filling said troughs; and
   emitter tips disposed superjacent said highly conductive material layer.

2. The cathode emitter structure according to claim 1, wherein said troughs are disposed parallel to one another, said troughs having a first end and a second end, said second ends of said troughs being connected to a trench, said trench being disposed substantially normal to said troughs.

3. The cathode emitter structure according to claim 2, wherein said emitter tips are selectively addressable through said trenches.

4. The cathode emitter structure according to claim 3, wherein said emitter tips comprise polysilicon.

5. The cathode emitter structure according to claim 4, wherein said conductive material layer comprises at least one of tungsten silicide (WSiX) and polysilicon.

6. The cathode emitter structure according to claim 2, wherein said conformal insulating layer is disposed on said substrate at said trenches.

7. A cathode emitter structure having a plurality of troughs disposed in a substrate, a conductive material layer substantially filling said troughs, and emitter tips disposed superjacent said conductive material layer, the structure formed by:

forming trenches in a substrate;

creating a conformal insulating layer superjacent said substrate, said conformal insulating layer for isolating emitter tips;

depositing a conductive layer superjacent said insulated trenches, said conductive layer for propagating an electrical signal through said trenches to said emitter tips; and etching said conductive layer thereby forming the emitter tips.

8. The process according to claim 7, wherein said trenches are arranged in substantially parallel rows, said rows being electrically isolated.

9. The process according to claim 8, wherein said insulating layer is approximately 500–5000 Å.

10. The process according to claim 9, wherein said insulating layer is comprised of at least one of silicon dioxide, silicon nitride, TEOS, and BPSG.

11. The process according to claim 10, wherein said conductive layer is selectively etchable to said insulating layer.

12. The process according to claim 11, wherein said emitter tips are disposed superjacent said trenches.

13. The process according to claim 11, wherein said emitter tips are disposed within said trenches.

14. The process according to claim 13, further comprising:

depositing a highly conductive layer between said insulating layer and said conductive layer, said highly conductive layer comprising tungsten silicide (WSiX).

15. A method for the formation of a baseplate having isolated emitter structures, said method comprising the following steps of:

forming troughs in a substrate;

depositing a highly conductive layer superjacent said substrate;

depositing cathode material layer superjacent said conductive layer, said cathode material layer comprising polysilicon; and etching said layers, thereby forming cathodes contiguous with said troughs, said cathodes being disposed above said troughs.

16. The method according to claim 15, further comprising depositing a conformal dielectric layer prior to depositing said highly conductive layer, said dielectric layer comprising at least one of silicon dioxide, silicon nitride, TEOS, and BPSG.

17. The method according to claim 16, further comprising planarizing said highly conductive material layer.

18. The method according to claim 17, wherein said dielectric layer physically separates said troughs of conical cathodes.

19. The method according to claim 18, wherein said conical cathodes are arranged in rows, said rows being substantially parallel to one another, a plurality of said rows of conical cathodes being disposed in each of said troughs.

* * * * *